US006127935A

United States Patent [19]

Davidson et al.

[11] Patent Number: 6,127,935

[45] Date of Patent: Oct. 3, 2000

[54] REVERSIBLE SPEAKER/STROBE MODULE

[75] Inventors: Curtis R. Davidson, Oswego; Douglas J. Anderson, S. Elgin, both of Ill.

[73] Assignee: Pittway Corporation, Chicago, Ill.

[21] Appl. No.: 09/311,806

[22] Filed: May 13, 1999

[51] Int. Cl.[7] ..... G08B 17/02

[52] U.S. Cl. ..... 340/691.5; 340/693.9; 340/577; 340/384.1; 340/815.73; 340/815.74; 340/396.1; 340/391.1; 340/691.5

[58] Field of Search ..... 340/691.5, 691.1, 340/693.9, 815.73, 815.74, 384.1, 396.1, 577, 391.1

[56] References Cited

U.S. PATENT DOCUMENTS

| | | | |
|---|---|---|---|
| 5,598,139 | 1/1997 | Karim et al. | 340/286.11 |
| 5,684,467 | 11/1997 | Hur | 340/693.9 |
| 5,805,071 | 9/1998 | Hur | 340/693.9 |
| 5,914,665 | 6/1999 | Thorp et al. | 340/691.1 |
| 5,969,627 | 10/1999 | Tarlton et al. | 340/693.12 |
| 6,057,778 | 5/2000 | Davidson | 340/693.5 |

*Primary Examiner*—Benjamin C. Lee
*Attorney, Agent, or Firm*—Rockey, Milnamow & Katz, Ltd.

[57] ABSTRACT

A system for mounting two alarm-indicating or condition-sensing modules side-by-side onto a junction box provides installation flexibility to locate a particular module on the right or left side of the respective other module. A loudspeaker module can be centered on the junction box and a strobe light module can be placed either on the right side or the left side of the junction box by 180° rotation of a common elongated rectangular frame and 180° rotation of the strobe light module with respect to the frame. The loudspeaker module includes fastener receiving holes aligned with fastener engagement holes of a standard 4"×4" junction box for securing the loudspeaker module and the common frame with the strobe light module attached thereto, to the junction box. The frame includes a recessed region to receive and support the strobe light module. A shroud can be provided under the frame to cover a surface mounted junction box and to provide an integrated and architecturally pleasing installation.

22 Claims, 5 Drawing Sheets

REVERSIBLE SPEAKER/STROBE MODULE

TECHNICAL FIELD OF THE INVENTION

The present invention relates to alarms and detectors for use in emergency systems such as fire alarm systems, burglar alarm systems. More particularly, the invention relates to reconfigurable modules usable in such systems which provide enhanced installation flexibility.

BACKGROUND OF THE INVENTION

Alarm systems are provided to monitor areas within a facility, for example in a building, a factory, a residence and the like. Known systems can include alarm-indicating modules mounted throughout a particular area.

Known types of modules include horn-type audible alarms, strobe alarms, or loudspeakers which are used to broadcast messages or instructions. An alarm-indicating module may be associated with a local detector, such as a smoke detector, or may be connected in some manner, such as by wiring deployed in a conduit, to a centralized control system.

The centralized system can also be connected to a plurality of condition-sensing devices, such as smoke detectors, deployed throughout the area. Upon receiving a signal from one or more of the detectors indicating that an emergency condition exists, the control system can trigger one or more of the alarm-indicating modules.

One such system is described for example in U.S. Ser. No. 08/838,002, filed Apr. 4, 1997, entitled "Cover For Surface Mounted Alarm Unit," assigned to the assignee of the present invention and incorporated herein by reference.

That application describes a modular system for mounting a plurality of alarm-indicating or condition-sensing modules to surface mounted junction boxes. The alarm-indicating or condition-sensing modules when located throughout an area, exhibit a common aesthetically pleasing appearance. The system includes a plurality of shrouds which surround and cover the surface mounted junction boxes and which carry the individual alarm-indicating or condition-sensing modules.

As recognized by the present inventors, it would be advantageous to provide a modular system which is adaptable for different installation locations and orientations to provide the most effective alarm-indicating or condition-sensing performance. As recognized by the present inventors, it would be advantageous to locate two types of alarm-indicating or condition-sensing modules at a single junction box. Also, as recognized by the present inventors, it would be advantageous to aesthetically integrate such alarm-indicating or condition-sensing modules throughout an area.

SUMMARY OF THE INVENTION

The present invention contemplates a mounting system for installing two, side-by-side, alarm-indicating or condition-sensing modules onto a single junction box. The present invention contemplates a modular assembly including two, side-by-side alarm-indicating or condition-sensing modules and a component frame which carries the modules and mounts to the junction box. The alarm-indicating module can be, for example, a strobe light or loudspeaker module. The condition-sensing module can be, for example, a smoke detector, a CO detector, or a motion detector.

The mounting system is configured to be rotatable 180° about a centerline thereof, perpendicular to the mounting surface of the junction box, to reverse the relative orientation of the side-by-side modules. In one embodiment at least one of the side-by-side modules is also rotatable 180° about a centerline thereof perpendicular to the mounting surface for inverting the module with respect to the remaining portions of the mounting system. This is useful in conjunction with the mounting system rotation of 180° to maintain a desired vertical orientation of the one module.

The mounting system is particularly adapted for mounting onto a surface mounted junction box via an interposed cover or shroud which covers the surface mounted junction box. The mounting surface of the junction box is typically a wall or ceiling of a building. The two side-by-side modules are carried by the shroud spaced from the mounting surface.

In an embodiment of the present invention, a mounting system attaches at least one alarm-indicating and/or condition-sensing module to a junction box with the one module carried at a position offset or eccentric from a centerline of the junction box. Operational advantages may be achieved by locating the at least one module offset from the junction box.

The mounting system includes a component frame having a mounting portion with fastener holes for receiving fasteners to engage a fastener-engaging hole of the junction box. The frame also includes a module carrying portion connected to the mounting portion, extending laterally therefrom to carry the at least one module. A second alarm-indicating and/or condition-sensing module can be carried on the mounting portion.

A shroud can be interposed between the frame and the junction box to conceal the junction box and to display the frame, in an aesthetically pleasing, architecturally integrated arrangement. The shroud, the frame, and the modules can be color coded depending on the alarm-indicating and/or condition-sensing emergency service, e.g., fire, weather, intruder alarm, etc.

A modular assembly of the present invention can include a loudspeaker module, as a first module, a strobe light module as a second module, and a component frame. The loudspeaker module and the strobe light module are mounted side-by-side on the component frame.

A loudspeaker housing is carried on one side of the component frame. The loudspeaker housing can be separate from or unitary with, the component frame. A plurality of screw-receiving bores penetrate through the loudspeaker module and the loudspeaker housing and are spaced and arranged to register with screw engaging apertures of a surface mounted junction box.

Next to the loudspeaker housing is a strobe light module support tray. The strobe light module support tray includes a recessed footprint for receiving the strobe light module. The strobe light module has a perimeter which is preferably symmetrical about a lateral and a longitudinal axes thereof. The symmetrical shape of the strobe light module perimeter and the corresponding recessed footprint of the tray allow the strobe light to be selectively rotated 180° and repositioned within the tray. This permits the strobe light module to be maintained upright when located either on the left side of the loudspeaker or on the right side of the loudspeaker depending on the location of the mounting system with respect to the surrounding architecture.

For a surface mounted junction box, a cover or shroud can be interposed between the component frame and the surface mounted junction box. The shroud includes a rectangular recessed footprint for receiving the component frame in nested fashion on a front surface of the shroud. The component frame is symmetrical about both the vertical and horizontal axes such that the component frame can be rotated 180° to switch the relative orientation of the strobe light with respect to the loudspeaker.

The flexibility to reposition the strobe light can be important when the junction box is mounted near to an obstacle or building side wall which could interfere with the transmission of the strobe light. It may be in such cases that by switching the location of the strobe light to either the left side or right side of the loudspeaker, the strobe light will sufficiently clear the obstacle to meet operational requirements. Such flexibility of location can enable the installation to meet industry installation requirements such as I.E., N.F.P.A. or N.E.C. guidelines.

As installed, the present system can provide on the component frame the loudspeaker module for giving audible instructions or warnings during an emergency, and the strobe light module for giving visual warning of the emergency, together as an integral assembly. The component frame can be mounted flush on a wall surface over a recessed junction box, or can be mounted over a surface mounted junction box. In both cases the combined component frame, the strobe light module and the loudspeaker module provide an integrated, architecturally pleasing design.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
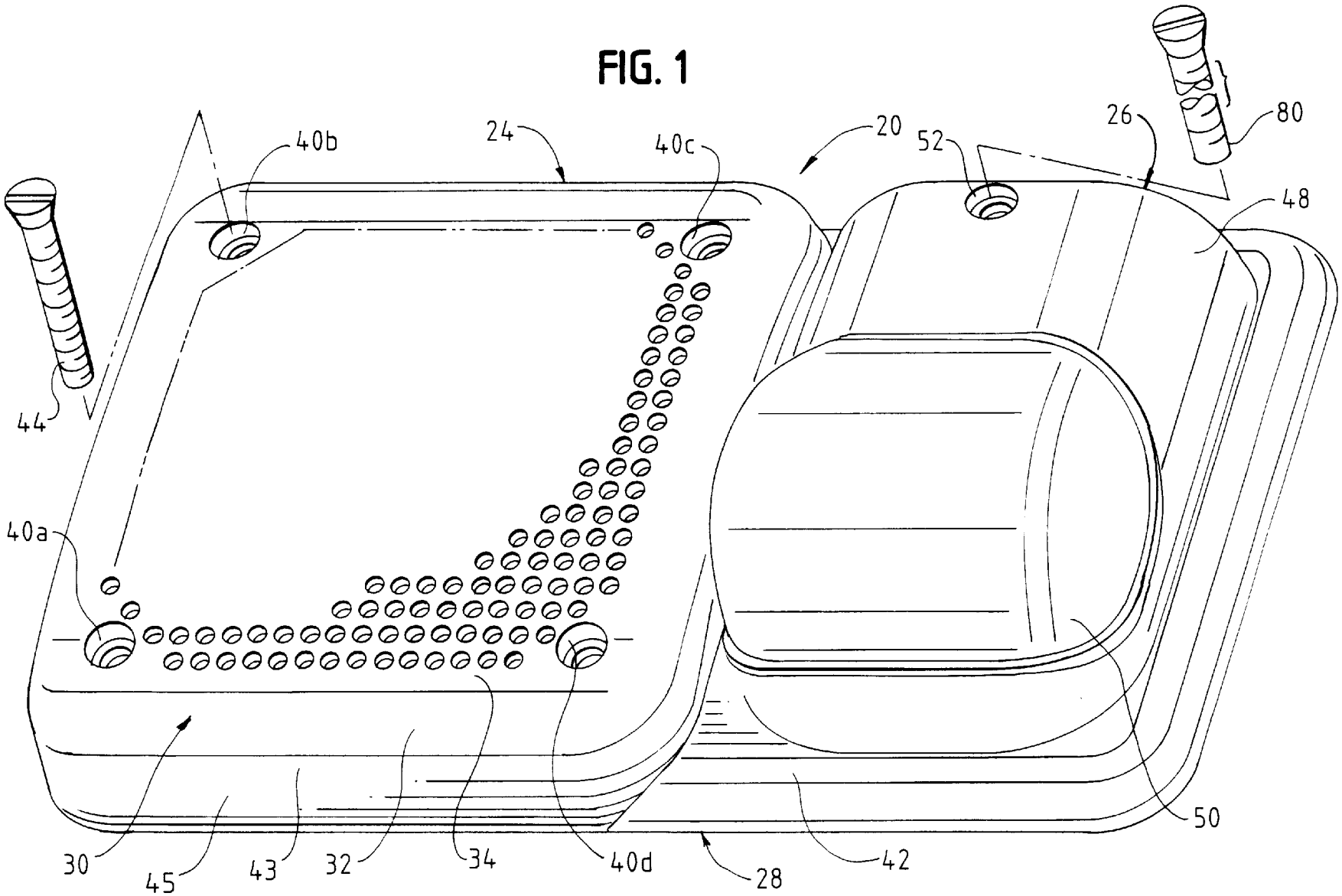
FIG. 1 is a perspective view of a module assembly according to the present invention including a center mounted loudspeaker module and a right mounted strobe light module.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates a component assembly 20 which includes a loudspeaker module 24 and a strobe light module 26, both mounted on a component frame 28. The loudspeaker module 24 includes a loudspeaker housing 30 having a surrounding side wall 32 and a perforated front wall 34. The front wall 34 includes screw-receiving holes 40*a*–40*d* at each of four corners.

The surrounding side wall 32 can be formed unitarily with the component frame 28 at the surrounding interface 43. Alternatively, the interface 43 can be a parting plane where the side wall 32 merely abuts a mounting portion 45 of the frame 28. In that case, the passing of four screws 44 (one of which is shown) through the screw-receiving holes 40*a*–40*d* of the housing 30, through the mounting portion 45, and the engagement of the screws 44 to a junction box located therebelow, clamps the side wall 32 to the frame 28.

It will be understood that fasteners other than screws can be used without departing from the spirit and scope of the present invention. For example, the box could be intended to be used with snap fit fasteners. Alternatively, the box can be provided with prongs onto which the assemblage 20 can be mounted.

The frame 28 includes a strobe light module support tray 42, which extends laterally from the mounting portion 45, for carrying the strobe light module 26. A screw-receiving hole 52 of the housing 48 receives a screw 80 to secure the strobe light module 26 to the tray 42.

The strobe light module 26 includes an oblong, substantially rectangular housing 48 having a glass dome or lens 50 which houses the strobe light element and reflector elements. The strobe light can be constructed in accordance with U.S. Ser. No. 08/811,542, filed Mar. 4, 1997 entitled "Reflector With Strobe Light Extending Therefrom," and assigned to the assignee of the present invention and herein incorporated by reference.

Figure 2:
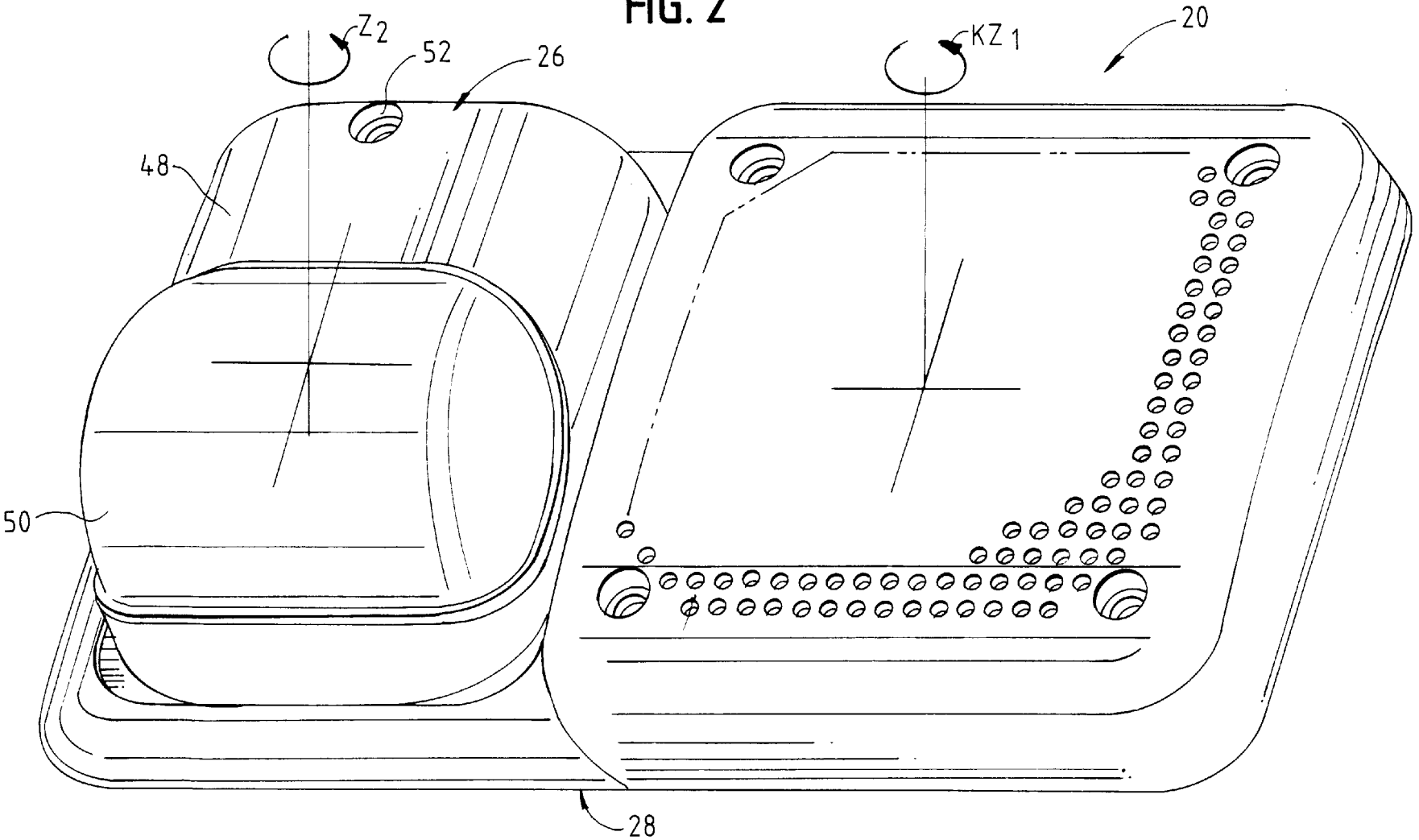
FIG. 2 is a perspective view of the assembly of FIG. 1 with the assembly rotated 180° and the strobe light module rotated 180° to provide a center mounted loudspeaker module and a left mounted strobe light module.

FIG. 2 illustrates the component assembly 20 rearranged to have the strobe light module 26 located on the left side of the assembly. To arrive at this configuration, the frame 28 is rotated 180° about the perpendicular axis Z1 with respect to a stationary junction box, and the strobe light module 26 is rotated 180° about the perpendicular axis Z2 with respect to the tray 42 of the frame 28.

Figure 3:
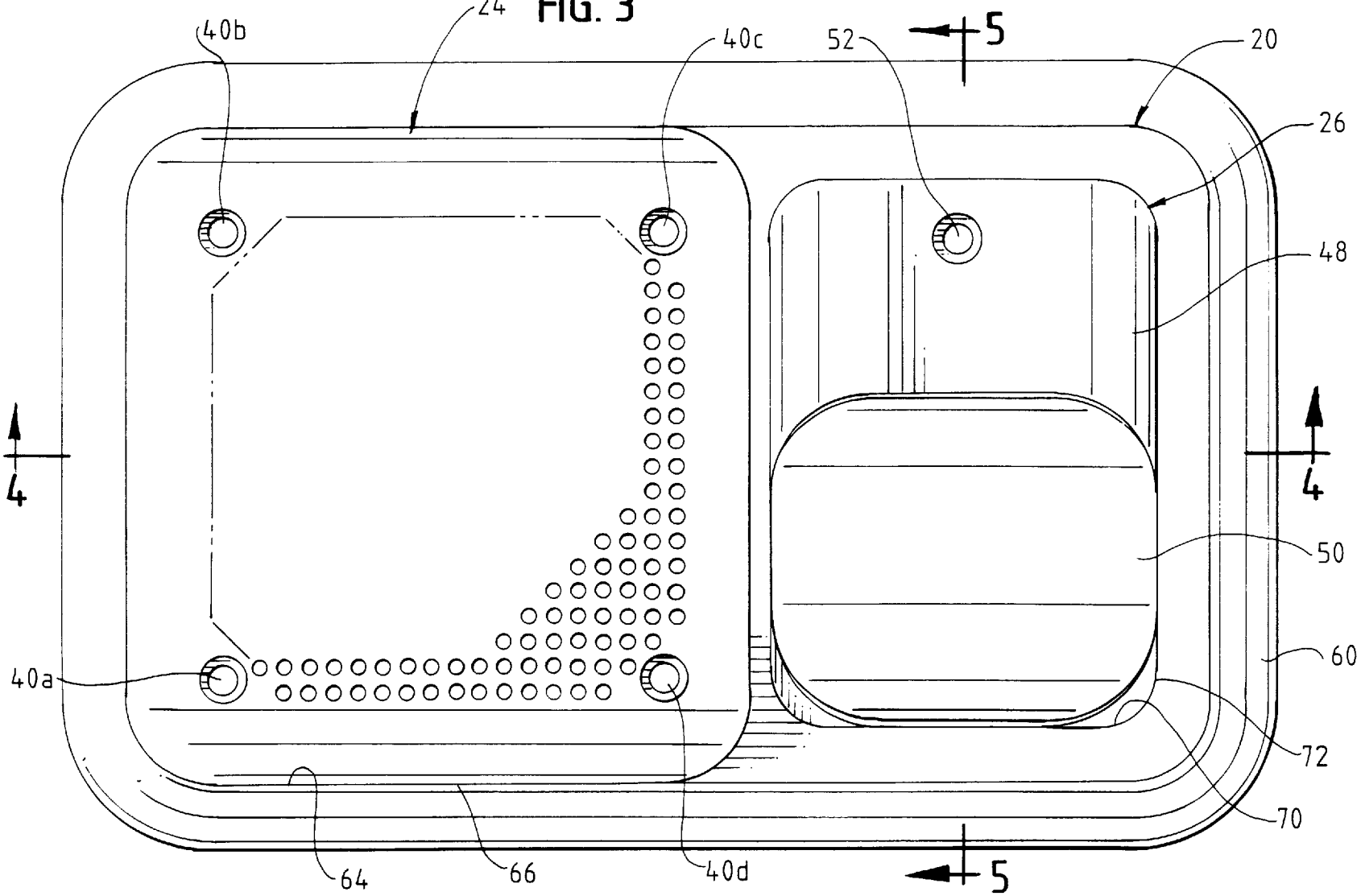
FIG. 3 is a front view of the assembly shown in FIG. 1 mounted on a shroud.

FIG. 3 illustrates the component assembly 20 mounted onto a shroud 60. The shroud 60 provides an indented footprint 64 which corresponds to the outer periphery 66 of the component assembly. Thus, the component assembly 20 fits snugly onto the shroud 60, nested into the footprint 64.

The tray 42 provides a recessed footprint 70 which corresponds to an outer perimeter 72 of the strobe light module 26. The strobe light module 26 can thus be nested snugly onto the tray 42. The footprint of the strobe light assembly is symmetrical about its vertical and horizontal axes, corresponding to the lines 5—5, and 4—4 respectively, shown in FIG. 3.

Thus, the strobe light module 26 can be rotated 180° and slid snugly into its nested footprint 70 of the tray 42.

Figure 4:
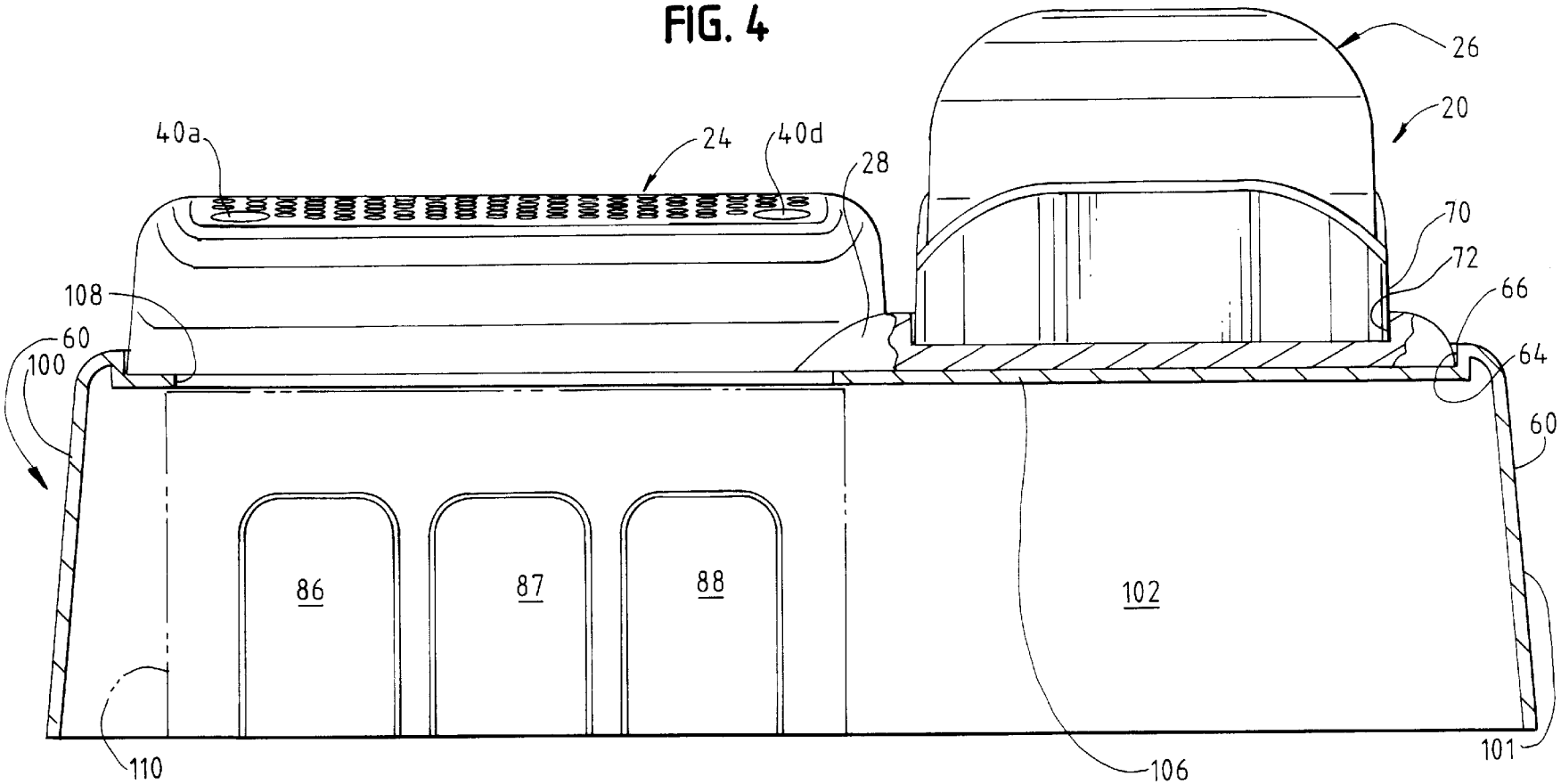
FIG. 4 is a sectional view taken generally along line 4—4 of FIG. 3, the module assembly being shown in profile for simplicity of depiction.

FIG. 4 shows weakened breakout panels 86, 87, 88. There are three breakout panels on each of the four shroud walls to allow a conduit to approach a surface mounted junction box from left, right, top or bottom, while permitting the shroud to cover the junction box and fit flushly against the surface.

Figure 5:
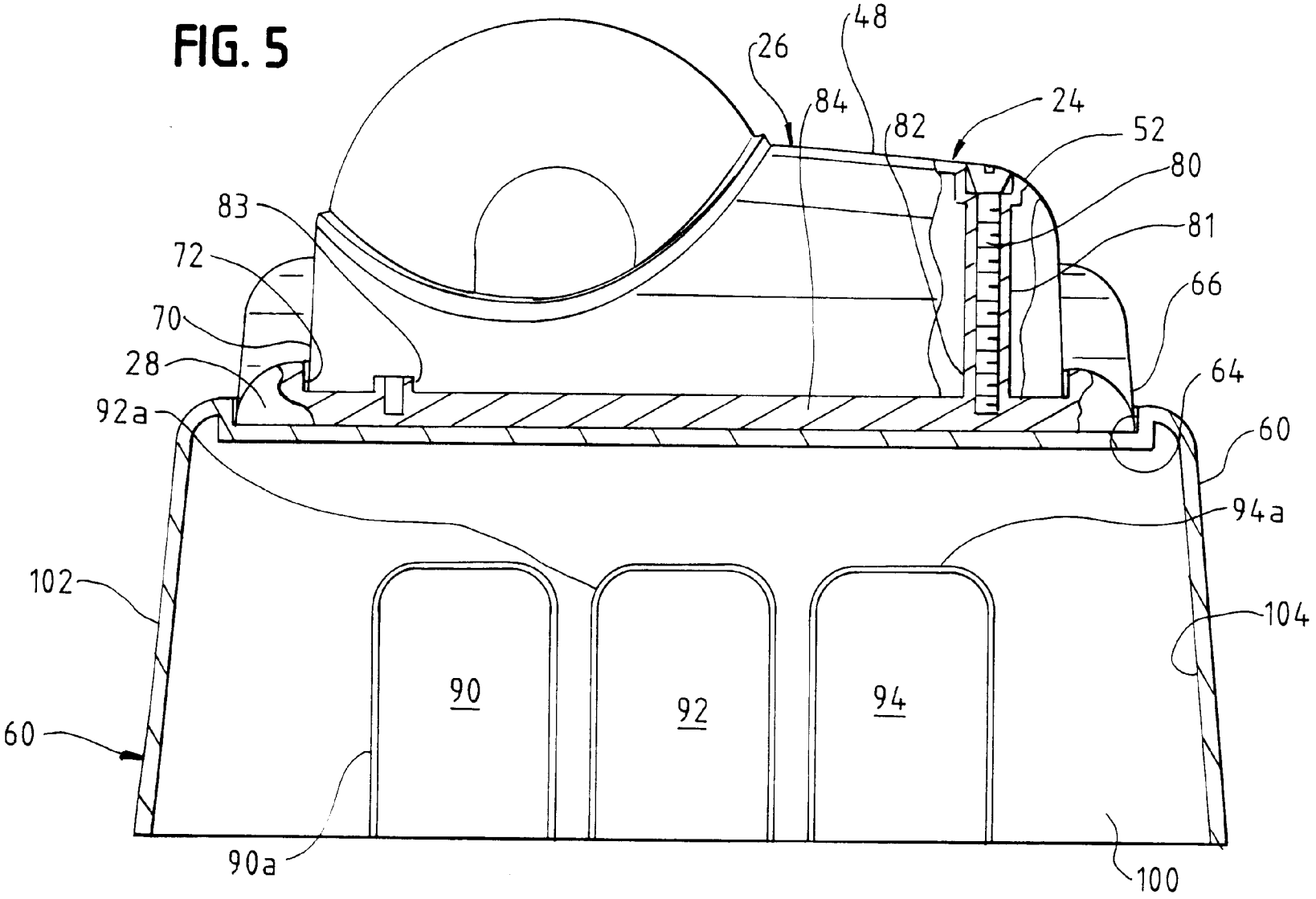
FIG. 5 is a sectional view taken generally along line 5—5 of FIG. 3, the module assembly shown in profile for simplicity of depiction.

FIGS. 4 and 5 illustrate that the shroud 60 includes side walls 100, 101 and end walls 102, 104. The four walls 100, 101, 102, 104 are connected by a front wall 106. An aperture 108 through the front wall 106 allows wires from the strobe light alarm as well as the rear portions of the loudspeaker (such as the loudspeaker magnet, not shown) to at least partially enter a junction box held within the shroud 60.

The junction box is shown in phantom as 110. The breakout panels on each of the fill shroud side walls register with punchouts for one or more conduits to be connected into the junction box 110. Thus, the removal of a panel corresponding to the location of the conduit into the junction box 110 allows the shroud 60 to be fit down over the junction box 110 and the conduit entering the junction box, and allows an edge of the shroud to flushly abut against the surface which carries the junction box. Screws 44 fit through the screw holes 40*a*–40*d* engage the standard screw receiving tabs of a junction box to hold, in clamping fashion, the shroud to the junction box by the overlying loudspeaker housing 30 and frame 28.

FIG. 5 shows the screw 80 received in the screw receiving bore 52 of the strobe light module 26, particularly of the housing 48. Screw 80 is fit within the bore 52, which is countersunk in a screw-receiving barrel 81, and threads into a screw-engaging barrel 82 formed in a floor 84 of the tray 42. A screw receiving barrel 83 is shown vacant but is used in the case of a left mounted strobe such as shown in FIG. 2, when the strobe light module is rotated 180° with respect to the tray 42. The shroud 60 includes breakout panels 90, 92, 94 defined by weakened perimeters 90*a*, 92*a*, 94*a* formed in the shroud sidewall 100. The perimeters can be defined by a thin region of the shroud sidewall 100 or by a partial cut through the shroud sidewall 100.

Depending on the location and orientation of the junction box 110 on the mounting surface, and depending on the orientation of the mounting surface with respect to obstructions and other architecture, the relative position of the loudspeaker 24 and the strobe light alarm 26 can be changed before installation to orient the strobe light on the left or right of the loudspeaker housing 30.

Although a loudspeaker and strobe light are shown in the Figures, according to the principles of the invention, dual alarm-indicating or condition-sensing modules of other types can be utilized, and mounted according to the frame and shroud heretofore described. For example, an alarm-indicating module can be mounted side-by-side with a condition-sensing module. Additionally, the frame and shroud can be used with a single alarm-indicating or condition-sensing module which is desired, for whatever reason, to be mounted eccentrically to a junction box.

In the event that a strobe module must be mounted a distance from the centerline of a surface mounted junction box, the frame 28 could be used without a loudspeaker module. The space for the loudspeaker module could be a plain flat panel having the screw holes 40*a*–40*d* for receiving the screw 44. Alternately, the space illustrated for the loudspeaker module could be dedicated to another purpose such as for containing controls, for providing a surface for instructions or other indicia, or for serving as a wiring junction box.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. An emergency service module assembly mountable to a junction box, comprising:

an elongated frame;

a first module carried by said frame;

a second module carried by said frame in side-by-side orientation to said first module, said first and second modules selected from the group that includes alarm-indicating modules and condition-sensing modules; and a fastener carrying structure carried by said frame and configured to align fasteners carried thereby to one or more fastener engaging holes of the junction box when installed.

2. The assembly according to claim 1, wherein said fastener carrying structure comprises portions of said first module which define screw receiving holes which are aligned with said fastener engaging holes of the junction box.

3. The assembly according to claim 1, wherein said frame includes a recessed region for receiving said second module in a nesting fashion.

4. The assembly according to claim 3, wherein said second module has a profile for being received into said recessed region, said profile being symmetrical for a 180° rotation about an axis normal to a direction of insertion of said module into said recessed region to invert said second module with respect to said frame.

5. The assembly according to claim 1, wherein said second module includes a fastener receiving hole and said frame includes a fastener engaging hole aligned therewith to secure said second module to said frame.

6. The assembly according to claim 1, further including a shroud sized to enclose a surface mounted junction box and including a recessed region to receive in nesting fashion said frame and said first and second modules carried by said frame.

7. The assembly according to claim 1, wherein said first module comprises a loudspeaker and said second module comprises a strobe light module.

8. The assembly according to claim 1, wherein said frame comprises an elongated rectangle having an outer surface which defines the outer perimeter of the assembly of said frame and said first and second modules.

9. The assembly according to claim 8, further comprising a shroud having a front wall and a depending perimeter skirt extending rearwardly, said skirt having a depth to enclose a surface mounted junction box, said front wall having a recessed region which receives said perimeter of said frame therein.

10. The assembly according to claim 9, wherein said first module comprises a loudspeaker module having a perforated front wall with four corner fastener-receiving holes which are aligned with fastener-engaging holes provided by a standard 4"×4" junction box, engagement of fasteners which are inserted through said fastener-receiving holes of said speaker module and engaged into said fastener-engaging holes of said junction box are effective to mount said first and second modules, said frame, and said shroud to said surface mounted junction box.

11. An alarm-indicating and/or condition-sensing assembly for mounting onto an electrical box, comprising:

a frame;

a first module carried by said frame, said first module selected from the group including alarm-indicating modules and condition-sensing modules; and a second module carried by said frame in a side-by-side orientation to said first module, said second module selected from the group.

12. The assembly according to claim 11, wherein said frame includes a recessed region for receiving said second module in nesting fashion.

13. The assembly according to claim 12, wherein said second module has a perimeter for being received into said recessed region, said perimeter being symmetrical for a 180° rotation about an axis normal to a direction of insertion of said module into said recessed region to invert said second module with respect to said frame.

14. The assembly according to claim 11, further including a shroud sized to enclose a surface mounted junction box and including a recessed region to receive in nesting fashion said frame and said first and second modules carried by said frame.

15. The assembly according to claim 11, wherein said frame comprises an elongated rectangle having an outer perimeter which defines an outside perimeter of the assembly of said frame and said first and second modules.

16. The assembly according to claim 15, further comprising a shroud having a front wall and a depending perimeter skirt extending rearwardly, said skirt having a depth to enclose a surface mounted junction box, said front wall having a recessed region which nestingly receives therein said outer perimeter of said frame.

17. The assembly according to claim 11, wherein said first module comprises a loudspeaker and said second module comprises a strobe light.

18. An alarm-indicating or condition-sensing assembly for mounting onto an electrical box, comprising:

an elongated frame having an attachment region at one lateral side for attachment to an electrical box; and a first module carried by said frame outside of said attachment region on an opposite lateral side of said frame, said first module selected from a group which includes alarm-indicating modules and condition-sensing modules, said first module and said frame configured for said first module to be carried alternately on a left side or a right side of said attachment region.

19. The assembly according to claim 18 further comprising a second module disposed in said attachment region, said second module selected from the group.

20. The assembly according to claim 18 wherein said first module comprises a light emitting element.

21. The assembly according to claim 18 wherein said first module comprises a condition-sensing module.

22. The assembly according to claim 21 wherein the condition sensing module is selected from a group which includes fire detectors and gas detectors.

* * * * *